US007320311B2

(12) United States Patent
Futonagane et al.

(10) Patent No.: US 7,320,311 B2
(45) Date of Patent: Jan. 22, 2008

(54) PRESSURE BOOSTING COMMON RAIL FUEL INJECTION APPARATUS AND FUEL INJECTION CONTROL METHOD THEREFOR

(75) Inventors: Yoshinori Futonagane, Susono (JP); Kazuhiro Omae, Atsugi (JP); Yoshihiro Hotta, Nagoya (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 129 days.

(21) Appl. No.: 10/560,105

(22) PCT Filed: Apr. 28, 2005

(86) PCT No.: PCT/IB2005/001144

§ 371 (c)(1),
(2), (4) Date: Dec. 9, 2005

(87) PCT Pub. No.: WO2005/106231

PCT Pub. Date: Nov. 10, 2005

(65) Prior Publication Data

US 2006/0144367 A1 Jul. 6, 2006

(30) Foreign Application Priority Data

Apr. 30, 2004 (JP) ..... 2004-135088

(51) Int. Cl.
*F02M 57/02* (2006.01)

(52) U.S. Cl. ..... 123/446; 123/458; 123/511

(58) Field of Classification Search ..... 123/446, 123/447, 500, 501
See application file for complete search history.

(56) References Cited

U.S. PATENT DOCUMENTS

| | | | | |
|---|---|---|---|---|
| 6,725,147 | B2 * | 4/2004 | Mollin | 701/104 |
| 6,792,917 | B2 * | 9/2004 | Kohketsu et al. | 123/446 |
| 6,892,703 | B2 * | 5/2005 | Magel | 123/446 |
| 6,962,141 | B2 * | 11/2005 | Kern | 123/446 |
| 7,083,113 | B2 * | 8/2006 | Kropp et al. | 239/92 |
| 2003/0150426 | A1 | 8/2003 | Tanabe et al. | |
| 2003/0213470 | A1 | 11/2003 | Kohketsu et al. | |
| 2004/0194756 | A1 | 10/2004 | Hotta et al. | |
| 2006/0196474 | A1 * | 9/2006 | Magel | 123/446 |

FOREIGN PATENT DOCUMENTS

JP B2 2526620 6/1996

(Continued)

*Primary Examiner*—Thomas Moulis
(74) *Attorney, Agent, or Firm*—Oliff & Berridge, PLC

(57) ABSTRACT

A fuel injection valve (10) with a pressure boosting unit is provided in an engine (1), and boosted pressure fuel injection is performed by increasing a pressure of fuel supplied to a fuel injection valve from a common rail (3). An ECU (20) decides a pressure boosting period that is defined as a time period from when the pressure of the fuel starts to be boosted until when the fuel injection is started using a numerical table in which a fuel injection amount and an engine rotational speed are used as parameters, and sets fuel injection control parameters such as a fuel injection period and pressure boosting starting timing, based on the pressure boosting period. Since the fuel injection control parameters are set based on the pressure boosting period, the control that is performed when the boosted pressure fuel injection is performed is simplified.

14 Claims, 7 Drawing Sheets

FOREIGN PATENT DOCUMENTS

| | | |
|---|---|---|
| JP | B2 2885076 | 2/1999 |
| JP | A 2002-539372 | 11/2002 |
| JP | A 2002-364484 | 12/2002 |
| JP | A 2004-44493 | 2/2004 |
| JP | A 2004-44494 | 2/2004 |
| WO | WO 00/55496 | 9/2000 |
| WO | WO 2004/007946 A1 | 1/2004 |

* cited by examiner

PRESSURE BOOSTING COMMON RAIL FUEL INJECTION APPARATUS AND FUEL INJECTION CONTROL METHOD THEREFOR

BACKGROUND OF THE INVENTION

1. Field of the Invention

The invention relates to a fuel injection control method. More particularly, the invention relates to a pressure boosting common rail fuel injection apparatus which includes pressure boosting means, and in which a pressure of fuel supplied from a common rail is further increased, and the fuel is injected from a fuel injection valve, and a fuel injection control method therefor.

2. Description of the Related Art

A so-called common rail fuel injection apparatus is generally known, in which high pressure fuel supplied from a fuel pump is stored in a common rail (an accumulator), the fuel is supplied to an in-cylinder fuel injection valve provided in each cylinder of an internal combustion engine so that the fuel is injected directly into a combustion chamber of each cylinder.

In the common rail fuel injection apparatus, a pressure in the common rail can be controlled to a given value. Therefore, a rate of injection from a fuel injection valve can be controlled to an appropriate value according to an engine operating state so that a good combustion state can be maintained in the cylinder, irrespective of the engine operating state.

Particularly, in a direct injection diesel engine, a fuel injection period during which fuel can be injected into the cylinder is limited, depending on a relationship between the fuel injection period and a position of a piston. Therefore, when an engine rotational speed is high while the engine is operated, the period during which fuel can be actually injected may become extremely short, and it may become difficult to supply a large amount of fuel to the cylinder. However, in the common rail fuel injection apparatus, a fuel injection pressure can be maintained at a high value irrespective of an engine rotational speed. Therefore, by using the common rail fuel injection apparatus, it is possible to supply a large amount of fuel into the combustion chamber in a short time so that a high rotational speed and high output can be achieved in the diesel engine.

Meanwhile, since supercharging is generally performed in diesel engines, it is required to further increase the output of the diesel engine by increasing the fuel injection amount and using the supercharging, and accordingly it is required to further intensify the fuel injection pressure so as to further increase an amount of fuel supplied to the cylinder.

However, in the common rail fuel injection apparatus, the fuel injection pressure has been already set to a high value (e.g., approximately 180 MPa) that is close to a limit value. Therefore, in order to further increase the fuel pressure in the common rail, it is necessary to increase a designed pressure of all elements of a fuel injection system such as the fuel pump, the common rail, and delivery pipes. However, it is not practical to increase the designed pressure of all the elements of the fuel injection system, considering problems such as an increase in cost and a decrease in reliability.

Accordingly, in order to solve the problems, a pressure boosting common rail fuel injection apparatus is proposed. In the pressure boosting common rail fuel injection apparatus, a fuel pressure in a common rail is set to a value that is substantially equal to, or lower than a fuel pressure in a common rail in a conventional apparatus, and a pressure boosting device is employed for further increasing the pressure of fuel supplied to a fuel injection valve from the common rail at a portion that is closest as possible to a nozzle hole of the fuel injection valve.

In the pressure boosting common rail fuel injection apparatus, since the pressure boosting device is used for further increasing the pressure of the fuel supplied to the fuel injection valve from the common rail, the actual fuel injection pressure of the fuel injection valve can be set to a higher value (e.g., approximately 250 MPa) by setting only the designed pressure of a portion from the pressure boosting means to the fuel injection valve to a high value while the designed pressure of the elements such as the fuel pump and the common rail is set to a value that is substantially equal to (or lower than) the designed pressure in the conventional apparatus. Therefore, it is possible to boost the fuel injection pressure while suppressing a large increase in the cost.

Published Japanese Translation of PCT application No. JP-T-2002-539372 discloses an example of such a pressure boosting common rail fuel injection apparatus using such a fuel boosting device.

In the pressure boosting common rail fuel injection apparatus disclosed in the Published Japanese Translation of PCT application No. JP-T-2002-539372, a pressure boosting unit including a pressure boosting piston is used as a pressure boosting device. The pressure boosting unit is provided between a common rail and a nozzle hole of a fuel injection valve. The pressure boosting piston is formed by connecting a pressure receiving piston with a large diameter, and a pressurizing piston with a small diameter. The pressure boosting piston pressurizes the fuel according to an area ratio between the pressure receiving piston and the pressurizing piston. That is, in the pressure boosting piston, the fuel pressure in the common rail is applied to the pressure receiving piston with the large diameter, whereby the fuel supplied to a pressurizing chamber from the common rail is pressurized by the pressurizing piston with the small diameter. Thus, the pressure of the fuel supplied to the fuel injection valve can be increased to a value higher than the fuel pressure in the common rail, which is decided according to the area ratio between the piston having the large diameter and the piston having the small diameter.

In the pressure boosting common rail fuel injection apparatus disclosed in the Published Japanese Translation of PCT application No. JP-T-2002-539372, the pressure boosting device increases the pressure of fuel supplied to the fuel injection valve. Accordingly, it is possible to increase the fuel injection pressure without increasing the designed pressure of elements of the entire fuel injection apparatus.

However, in a case where the pressure boosting device is provided so that the fuel injection pressure is increased, if the same fuel injection control as that performed in the conventional common rail fuel injection apparatus is employed, the control becomes complicated.

In the conventional common rail fuel injection apparatus, the volume of the common rail is set so as to be sufficiently large compared to the amount of fuel injected one time, the fuel pressure supplied to the fuel injection valve is constant throughout the fuel injection period (the period during which the fuel injection valve is opened) is constant.

Accordingly, in the conventional common rail fuel injection apparatus, the fuel injection amount is decided based on an engine operating condition (accelerator pedal operation amount (a depression amount of an accelerator pedal) and an engine rotational speed), using a numerical table (map) that is made in advance. Then, required common rail fuel pressure (fuel injection pressure) and injection timing (injection starting timing) are decided based on the decided fuel injection amount and the engine rotational speed, using respective separate maps which are prepared in advance, and in which fuel injection amount and the engine rotational speed are used as parameters. Also, the fuel injection period (the period during which the fuel injection valve is opened) is decided using a map in which the fuel injection amount and the common rail pressure are used as parameters.

Meanwhile, when using the pressure boosting common rail fuel injection apparatus including a boosting piston as disclosed in the Published Japanese Translation of PCT application No. JP-T-2002-539372, it takes certain time until the fuel pressure is increased to a final pressure (boosted pressure) after operation of the boosting device is started, and the fuel pressure is changed (increased) with time until the boosted pressure is reached. Therefore, when the fuel injection period is overlapped with the period during which the pressure is being increased at the time of boosting the pressure, the fuel injection pressure is changed during the fuel injection.

Therefore, even if a target fuel pressure is decided, for example, based on the fuel injection amount and the engine rotational speed, it is necessary to perform an additional complicated calculation considering the increase in the fuel pressure during a period (pressure boosting period) from when operation of the pressure boosting means is started until when the fuel injection is started, and pressure boosting start timing, in order to decide timing at which the actual fuel injection pressure becomes equal to the aforementioned target fuel pressure.

Further, in the case where the fuel injection period is decided using the map in which the fuel injection amount and the common rail pressure are used as parameters according to the conventional method, when the fuel injection pressure is changed (i.e., the rate of injection is changed) during the injection, it is necessary to provide maps in which multiple parameters are used, for example, according to a change pattern of the fuel injection pressure during boosting of the pressure, and the injection starting timing, since the fuel injection period varies depending on a time point at which the fuel pressure used for deciding the fuel injection period is obtained. As a result, the calculation of the fuel injection period becomes complicated.

Accordingly, in the case where the pressure boosting common rail fuel injection apparatus is used, if the fuel injection control is performed using the same map as that used in the conventional method, the control becomes complicated.

SUMMARY OF THE INVENTION

In view of the above, it is an object of the invention to provide a pressure boosting common rail fuel injection apparatus, and a fuel injection control method therefor, which makes it possible to simplify control of the pressure boosting common rail fuel injection apparatus without increasing the number of maps and parameters.

A first aspect of the invention relates to a fuel injection control method for controlling a fuel injection characteristic of a pressure boosting common rail fuel injection apparatus. The pressure boosting common rail fuel injection apparatus includes a fuel injection valve which directly injects fuel into a combustion chamber of an internal combustion engine; a common rail which stores fuel having a predetermined pressure and supplies the fuel to the fuel injection valve; and pressure boosting means for increasing the pressure of the fuel supplied to the fuel injection valve from the common rail to a predetermined boosted pressure that is higher than the predetermined pressure of the fuel in the common rail. The pressure boosting common rail fuel injection apparatus performs boosted pressure fuel injection by operating the pressure boosting means so as to increase a fuel injection pressure of the fuel injection valve when necessary. The fuel injection control method includes the steps of deciding a fuel injection amount that is an amount of fuel to be injected from the fuel injection valve according to an engine operating state when the boosted pressure fuel injection is performed; and deciding a pressure boosting period that is defined as a time interval from when operation of the pressure boosting means is started until when the fuel injection is started, based on a relationship that is defined in advance using the decided fuel injection amount and an engine rotational speed.

That is, in the first aspect, the fuel injection amount is decided based on the engine operating state such as an accelerator pedal operation amount and the engine rotational speed, using a numerical map that is made in advance, or the like. Then, the pressure boosting period is decided based on the decided fuel injection amount and the engine rotational speed, using a predetermined function (for example, a numerical map).

When the pressure boosting means starts to boost the pressure of the fuel supplied to the fuel injection valve, the fuel pressure starts to be increased. After a certain time elapses, the fuel pressure reaches the predetermined boosted pressure that is higher than the common rail pressure, and becomes constant. A time-dependent change in the fuel pressure after the fuel pressure starts to be boosted varies depending on the common rail pressure, a specification of the pressure boosting means, and the like. However, when the common rail pressure and the specification of the pressure boosting means are decided, the fuel pressure after the fuel pressure starts to be boosted (for example, after a command signal is output to the pressure boosting means) is decided only by elapsed time after the fuel pressure starts to be boosted.

Accordingly, in this case, when the pressure boosting period, which is defined as the time period from when operation of the pressure boosting means is started (the fuel pressure actually starts to be increased) until when the fuel injection is started, is decided, the fuel injection pressure when the fuel injection is started and the change in the fuel injection pressure after the start of the fuel injection are decided. Therefore, the fuel injection characteristic (for example, a change in the fuel injection rate) can be represented only by the pressure boosting period.

According to the invention, the pressure boosting period which makes it possible to obtain the optimal fuel injection characteristic such as the optimal fuel injection rate is obtained in advance according to the engine rotational speed and the required fuel injection amount, at each common rail pressure. In the actual fuel injection control, the required pressure boosting period is decided based on a relationship that is defined in advance using the fuel injection amount and the engine rotational speed.

Thus, it is possible to control the fuel injection characteristic easily even when the boosted pressure fuel injection is performed, without increasing the number of parameters for calculations, or mailing the control complicated.

The pressure boosting period which makes it possible to obtain the optimal fuel injection characteristic may be obtained in advance according to the fuel injection amount and the engine rotational speed, for example by performing experiment using an actual fuel injection apparatus, and values of the pressure boosting period may be stored in a control device in the form of a three dimensional numerical map in which the fuel injection amount and the engine rotational speed are used as parameters.

In the first aspect, when the boosted fuel injection is performed, the pressure of the fuel in the common rail may be controlled to a constant base rail pressure irrespective of the engine operating state, fuel injection starting timing may be decided based on a relationship that is defined in advance using the fuel injection amount and the engine rotational speed, and operation starting timing of the pressure boosting means at which operation of the pressure boosting means is started may be decided based on the decided fuel injection starting timing and the pressure boosting period. Since it is not necessary to provide a map for each common rail pressure when the pressure boosting period is decided based on the fuel injection amount and the engine rotational speed, a calculation of the pressure boosting period is simplified.

In the first aspect, the fuel injection timing (fuel injection starting timing) is decided based on the fuel injection amount and the engine rotational speed as in the conventional case. However, as soon as the fuel injection timing is decided, the operation starting timing of the pressure boosting means, that is, pressure boosting starting timing at which the fuel pressure starts to be increased is decided based on the pressure boosting period that is thus calculated. Therefore, the pressure boosting starting timing can be calculated easily.

Thus, according to the invention, it is possible to control the fuel injection characteristic easily even when the boosted pressure fuel injection is performed, without increasing the number of parameters for calculations, or making the control complicated.

In an aspect relating to the first aspect, the pressure boosting period may be set to a negative value in a case where the fuel injection is started before the operation of the pressure boosting means is started, and the pressure boosting period may be set to a positive value in a case where the fuel injection is started after the operation of the pressure boosting means is started. With this arrangement, one numerical map or one relational expression can indicate values of the pressure boosting period in both of the case where the fuel injection is started before the operation of the pressure boosting means is started (that is, in the case where the fuel injection is performed at the base rail pressure during at least a portion of a fuel injection period), and the case where the fuel injection is started after the operation of the pressure boosting means is started. Therefore, the control of the fuel injection characteristic can be further simplified when the boosted pressure fuel injection is performed.

In an aspect relating to the first aspect, a relationship between the operation starting timing of the pressure boosting means and the fuel injection timing may be set according to the engine operating state such that (1) in a case where the engine is operated at an intermediate load, the fuel injection is started before the operation of the pressure boosting means is started, and the fuel injection is ended after the operation of the pressure boosting means is started, and before the pressure of the fuel supplied from the common rail to the fuel injection valve reaches the boosted pressure; (2) in a case where the engine is operated at a load lower than the intermediate load, the fuel injection is ended before the operation of the pressure boosting means is started; (3) in a case where the engine is operated in a vicinity of a maximum torque point, the fuel injection is started after the operation of the pressure boosting means is started, and before the pressure of the fuel supplied from the common rail to the fuel injection valve reaches the boosted pressure, and the fuel injection is ended after the pressure of the fuel reaches the boosted pressure; and (4) in a case where the engine is operated in a vicinity of a maximum output point, the fuel injection is started after the operation of the pressure boosting means is started, and after the pressure of the fuel supplied from the common rail to the fuel injection valve reaches the boosted pressure. With this arrangement, since the pressure boosting period is changed according to the engine operating state, a change pattern of the fuel injection pressure during a period from when the fuel injection is started until when the fuel injection is ended is changed according to the engine operating state. Therefore, it is possible to set the fuel injection rate to the optimal value according to the engine operating state, and to maintain the optimal combustion state of the engine irrespective of the engine operating state.

In each of the first aspect and the aspect relating to the first aspect, it is possible to obtain the common effect of preventing an increase in the number of maps and parameters, and simplifying the control when the pressure boosting common rail fuel injection apparatus is used.

In an aspect relating to the first aspect, the pressure boosting means may be prohibited from being operated in a case where the fuel injection is ended before the operation of the pressure boosting means is started. With this arrangement, when the fuel injection is performed without operating the pressure boosting means, that is, when the fuel injection is performed at the base rail pressure, the pressure boosting means is prohibited from being operated. When the pressure boosting means is operated, power for driving the pressure boosting means is increased, and an amount of consumption of leak fuel that is used as operating oil is also increased. Thus, by prohibiting the pressure boosting means from being operated when the fuel injection is performed at the base rail pressure, it is possible to prevent an increase in the power and the leak fuel.

In the aspect relating to the first aspect, switching may be performed between the boosted fuel injection and normal pressure fuel injection that is performed with the pressure boosting means being in a non-operated state; the base rail pressure may be set to a value equal to a lowest fuel injection pressure during the boosted pressure fuel injection; and in a case where the fuel injection pressure lower than the base rail pressure is required when the normal pressure fuel injection is performed, the pressure of the fuel in the common rail may be set to a value lower than the base rail pressure by opening a pressure reducing valve provided in the common rail. With this arrangement, a pressure increasing ratio of the pressure boosting means (a ratio between the boosted pressure and the common rail pressure) can be set to a small value, as compared to a case where a difference between the lowest pressure during the boosted pressure fuel injection and the base rail pressure is large. Also, it is possible to reduce the power for driving the pressure boosting means and the amount of leak fuel for operating the pressure boosting means.

In the aspect relating to the first aspect, switching may be performed between the boosted fuel injection and normal pressure fuel injection that is performed with the pressure boosting means being in a non-operated state; the base rail pressure may be set to a value equal to a lowest fuel injection pressure during the boosted pressure fuel injection; and in a case where the fuel injection pressure lower than the base rail pressure is required when the normal pressure fuel injection is performed, the pressure of the fuel in the common rail may be set to a value lower than the base rail pressure by controlling a discharge flow rate of a high pressure fuel injection pump which supplies the fuel to the common rail. With this arrangement, the pressure increasing ratio of the pressure boosting means (the ratio between the boosted pressure and the common rail pressure) can be set to a small value. Also, it is possible to reduce the power for driving the pressure boosting means and the amount of leak fuel for operating the pressure boosting means.

Also, in a case where the fuel injection pressure is set to a value lower than the base rail pressure when the normal pressure fuel injection is performed, the common rail pressure is reduced by controlling (reducing) the amount of fuel supplied to the common rail, instead of using the pressure reducing valve. Thus, it is possible to prevent unnecessary supply of high-pressure fuel, and to reduce driving force for the high-pressure fuel injection pump.

In an aspect relating to the first aspect, the boosted pressure fuel injection may be performed in a first engine operating region in which the engine is operated at a high load; the normal pressure fuel injection may be performed with the fuel injection pressure being set to the value lower than the base rail pressure in a second engine operating region in which the engine is operated at a load lower than the high load; and an engine operating region may be provided in the first engine operating region in a vicinity of a boundary between the first engine operating region and the second engine operating region, and in the engine operating region, the fuel injection may be performed with the pressure of the fuel in the common rail being set to a value equal to the base rail pressure, and with the pressure boosting means being in the non-operated state. With this arrangement, when the engine is actually operated, the normal pressure fuel injection is performed in a broad engine operating region. Thus, it is possible to prevent power consumption and the amount of leak fuel from being increased due to the operation of the pressure boosting means.

Also, as described above, the base rail pressure is set to the lowest fuel injection pressure during the boosted pressure fuel injection. Therefore, it is possible to continuously change the fuel injection pressure according to the engine operating state. That is, it is possible to perform the normal pressure fuel injection at the pressure lower than the base rail pressure, the boosted pressure fuel injection at the base rail pressure, and the boosted pressure fuel injection at the boosted pressure.

In the aspect relating to the first aspect, when the boosted pressure fuel injection is performed, a valve opening period of the fuel injection valve may be decided based on a relationship that is defined in advance using the pressure boosting period and the fuel injection amount.

Since the common rail pressure is set to the constant value (base rail pressure), when the pressure boosting period is decided, a change in the fuel injection pressure during the fuel injection is decided. Therefore, a fuel injection period can be represented using only the fuel injection amount and the pressure boosting period.

With this arrangement, for example, values of the fuel injection period are obtained in advance while changing combination of the fuel injection amount and the pressure boosting period through experiment using an actual fuel injection valve, and the values are maintained in the form of a numerical map in which the fuel injection amount and the pressure boosting period are used as parameters. Thus, it is possible to easily calculate the valve opening period of the fuel injection valve (fuel injection period) based on the pressure boosting period and the fuel injection amount while the engine is operated.

In an aspect relating to the first aspect, when the boosted pressure fuel injection is performed, a valve opening period of the fuel injection valve may be decided based on a relationship that is predefined in advance using the pressure boosting period and the fuel injection amount; and when the normal pressure fuel injection is performed, the valve opening period of the fuel injection valve may be decided based on the pressure of the fuel in the common rail and the fuel injection amount. With this arrangement, when the boosted pressure fuel injection is performed, the fuel injection control is performed such that the fuel injection period is decided based on the pressure boosting period and the fuel injection amount. Meanwhile, when the normal pressure fuel injection is performed, the conventional fuel injection control for a common rail fuel injection apparatus is performed such that the fuel injection period is decided based on the pressure of the fuel in the common rail and the fuel injection amount. Thus, when the boosted pressure fuel injection is performed, the control suitable for the boosted pressure fuel injection mode is performed. Also, when the normal pressure fuel injection is performed, the control suitable for the normal pressure fuel injection mode is performed.

In the aspect relating to the first aspect, when the boosted pressure fuel injection is performed, the operation of the pressure boosting means may be stopped simultaneously with an end of the fuel injection from the fuel injection valve.

In a case where the fuel injection is performed while the pressure boosting means is operated, when the fuel injection is ended before the operation of the pressure boosting means is stopped, the pressure of the fuel in a pipe connecting the fuel injection valve to the pressure boosting means may be sharply increased (i.e., pressure overshoot may occur) simultaneously with the end of the fuel injection, and the pressure of the fuel in the pipe may become equal to or higher than the boosted pressure at the peak. Therefore, a design pressure of a pipe member between the fuel injection valve and the pressure boosting means needs to be set considering the pressure overshoot at the end of the boosted pressure fuel injection. With the aforementioned arrangement, since the operation of the pressure boosting means is stopped simultaneously with the end of the fuel injection, it is possible to prevent occurrence of pressure overshoot at the end of the fuel injection. Therefore, there is an advantage that the design pressure of the pipe member between the fuel injection valve and the pressure boosting means does not need to be set to an unnecessarily high value.

In the aspect relating to the first aspect, when the boosted pressure fuel injection is performed, the operation of the pressure boosting means may be stopped before an end of the fuel injection from the fuel injection valve. With this arrangement, the operation of the pressure boosting means is stopped, and the fuel injection pressure starts to be decreased before the end of the fuel injection. Therefore, it is possible to decrease the fuel injection rate in an end stage of the fuel injection, as well as preventing occurrence of pressure overshoot. Thus, it is possible to obtain a change pattern of the fuel injection rate that cannot be obtained in the conventional case.

A second aspect of the invention relates to a fuel injection apparatus. The fuel injection apparatus includes a fuel injection valve which directly injects fuel into a combustion chamber of an internal combustion engine; a common rail which stores fuel having a predetermined pressure and supplies the fuel to the fuel injection valve; a pressure boosting device which increases the pressure of the fuel supplied to the fuel injection valve from the common rail to a predetermined boosted pressure that is higher than the predetermined pressure of the fuel in the common rail; and a controller which decides a fuel injection amount that is an amount of fuel to be injected from the fuel injection valve according to an engine operating state when boosted pressure fuel injection is performed with the pressure boosting device being operated so as to increase a fuel injection pressure of the fuel injection valve, and which decides a pressure boosting period that is defined as a time interval from when operation of the pressure boosting device is started until when the fuel injection is started, based on the decided fuel injection amount and an engine rotational speed.

DETAILED DESCRIPTION OF THE PREFERRED EMBODIMENTS

Hereinafter, an embodiment of the invention will be described with reference to the accompanying drawings.

Figure 1:
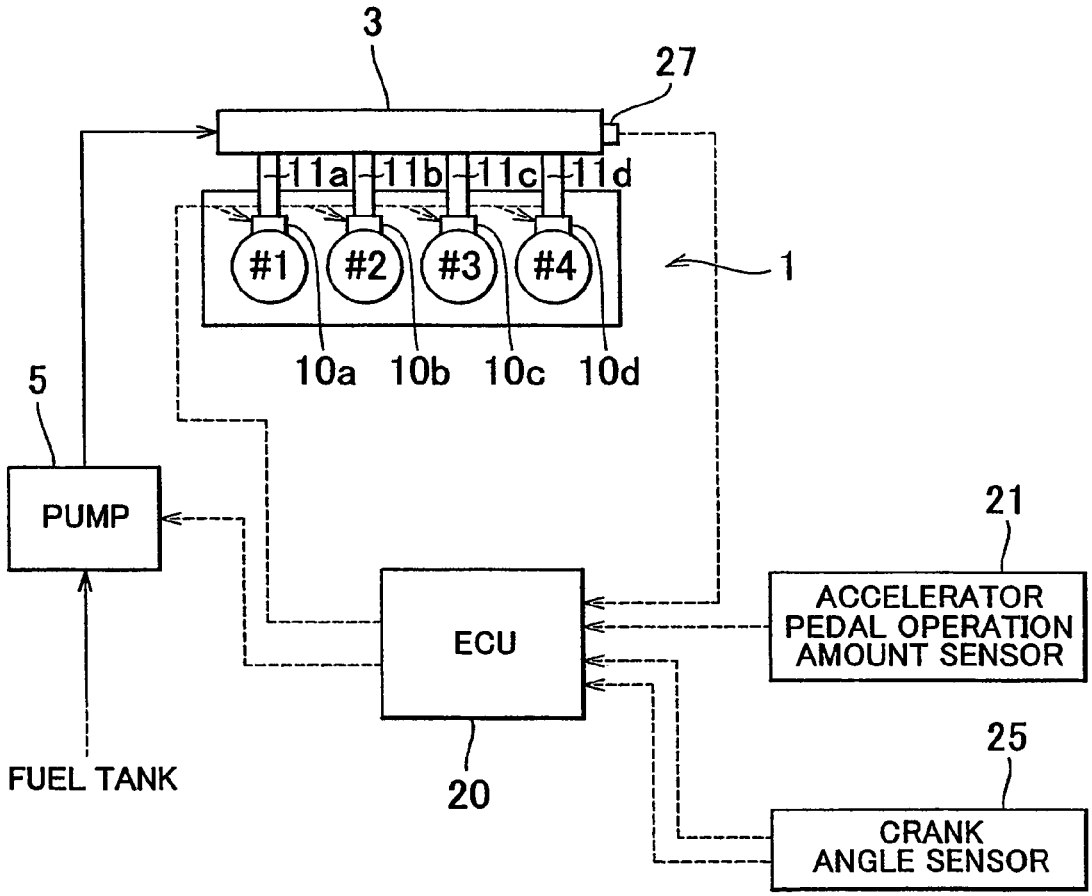
FIG. 1 is a schematic diagram explaining a configuration of an embodiment in which the invention is applied to an internal combustion engine for an automobile.

FIG. 1 is a schematic diagram showing a configuration in a case where a fuel injection apparatus which is controlled by a fuel injection control method according to the invention is used in a diesel engine for an automobile.

In FIG. 1, an internal combustion engine 1 includes fuel injection valves 10*a* to 10*d* each of which includes a pressure boosting unit and injects fuel directly into each of cylinders #1 to #4. In this embodiment, a four-cylinder four-cycle diesel engine including four cylinders #1 to #4 is used as the internal combustion engine 1. The fuel injection valves 10*a* to 10*d* are connected to a common accumulator (common rail) 3 through high pressure fuel pipes 11*a* to 11*d*, respectively. The common rail 3 stores pressurized fuel supplied by a high pressure fuel injection pump 5, and distributes the high pressure fuel to the fuel injection valves 10*a* to 10*d* through the high pressure fuel pipes 11*a* to 11*d*, respectively.

In the embodiment of the invention, for example, the high pressure fuel injection pump 5 is a plunger type pump including a flow rate adjusting mechanism. The high pressure fuel injection pump 5 increases a pressure of fuel supplied from a fuel tank (not shown) to a predetermined pressure, and then supplies the fuel to the common rail 3. The amount of fuel delivered to the common rail 3 from the pump 5 under pressure is controlled by an Electronic control unit (hereinafter, referred to as "ECU") 20 through feedback so that the pressure of the common rail 3 becomes equal to a target pressure.

In FIG. 1, the ECU 20 controls the internal combustion engine 1. The ECU 20 is configured as a digital computer having a known configuration in which a read only memory (ROM), a random access memory (RAM), a microprocessor (CPU), and input/output ports are connected to each other using a bi-directional bus. The ECU 20 controls valve opening timing and a valve opening period of each of the fuel injection valves 10*a* to 10*d*, operation starting timing of each of pressure boosting units 110*a* to 110*d* (described later), and the like, thereby controlling fuel injection timing and a fuel injection amount of each of the fuel injection valves 10*a* to 10*d*. In addition, the ECU 20 performs basic controls of the engine such as a control of an engine rotational speed.

In order to perform these controls, in this embodiment, a fuel pressure sensor 27 for detecting the fuel pressure in the common rail 3 is provided in the common rail 3. Also, an accelerator pedal operation amount sensor 21 for detecting an accelerator pedal operation amount (a depression amount of an accelerator pedal operated by a driver) is provided in the vicinity of the accelerator pedal (not shown) for the engine 1.

In FIG. 1, a crank angle sensor 25 detects a rotational phase of a crankshaft of the engine 1. The crank angle sensor 25 is provided in the vicinity of the crank shaft. The crank angle sensor 25 generates a crank angle pulse signal every predetermined crank angle (e.g., every 15 degrees), and outputs a reference pulse signal every 720 degrees of the crank angle.

The ECU 20 calculates the engine rotational speed based on frequency of the crank angle pulse signal input thereto from the crank angle sensor 25. In this embodiment, the output from the accelerator pedal operation amount sensor 21 and the engine rotational speed calculated based on the output from the crank angle sensor 25 are used for fuel injection control for controlling the fuel injection from the fuel injection valve.

Also, the ECU 20 calculates the rotational phase of the crank shaft (present crank angle) based on the number of the crank angle pulse signals after the reference pulse signal of the crank angle sensor 25 is input thereto.

Next, description will be made of the configuration of the fuel injection valve 10 with the pressure boosting unit (since the fuel injection valves 10*a* to 10*d* have the same configuration, hereinafter, collectively referred to as "fuel injection valve 10") in this embodiment of the invention.

Figure 2:
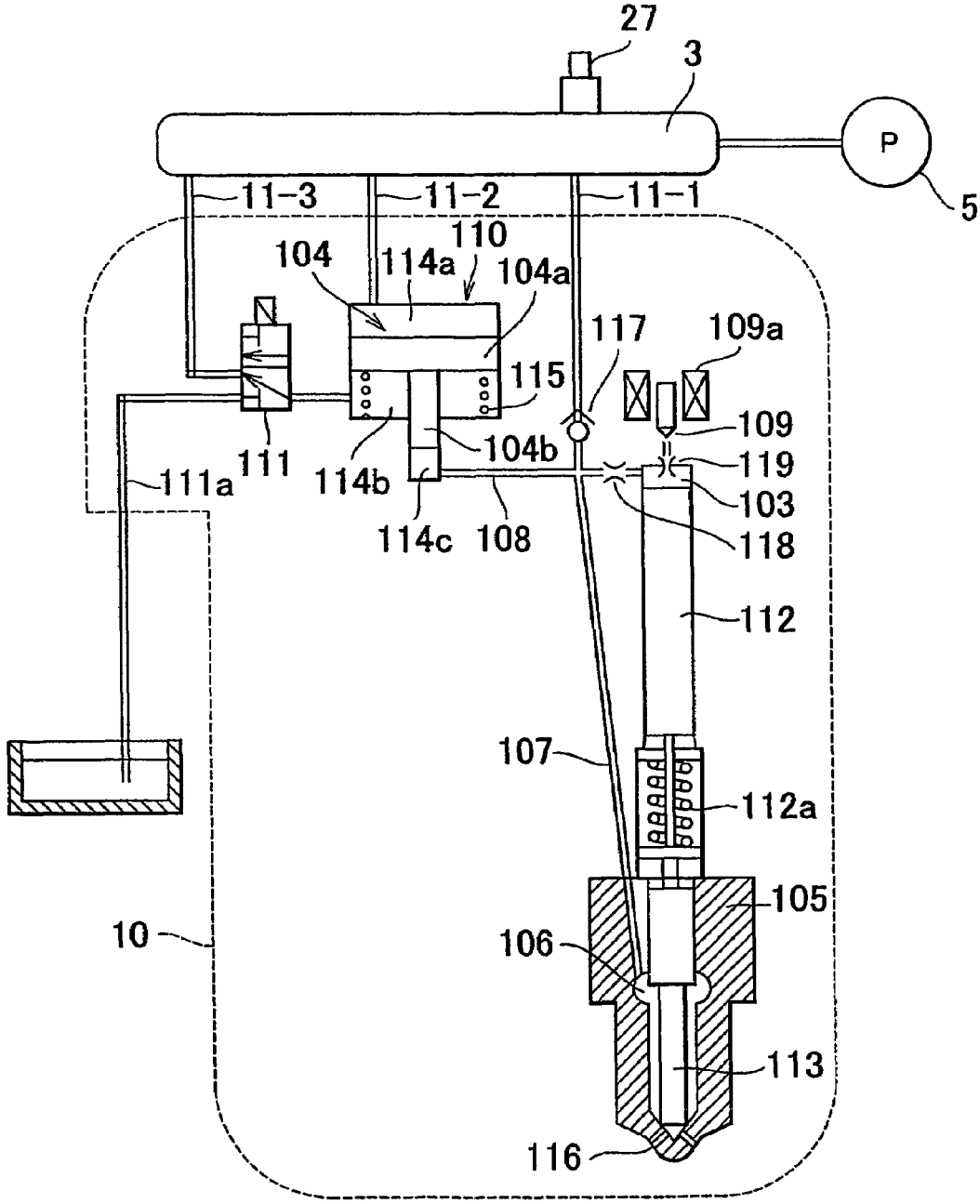
FIG. 2 is a schematic diagram explaining an example of a configuration of a fuel injection valve with a pressure boosting unit.

FIG. 2 is a schematic diagram showing the configuration of the fuel injection valve 10 with the pressure boosting unit in this embodiment of the invention.

FIG. 2 shows the entire fuel injection valve 10 with the pressure boosting unit. As shown in FIG. 1, the fuel injection valve 10 is connected to the common rail 3 through the high pressure pipe 11. In FIG. 2, the three high pressure pipes 11-1, 11-2, 11-3 are shown for the sake of convenience. However, the three pipes may extend from one high pressure pipe 11.

In FIG. 2, a pressure boosting unit 110, and a pressure boosting control valve 111 are provided.

A needle 113 opens/closes a nozzle hole 116 of a nozzle portion 105 of the fuel injection valve 10. A fuel pit 106 is formed around the needle 113 in the nozzle portion 105.

A command piston 112 in FIG. 2 receives a hydraulic pressure in an injection control chamber 103 described later and presses the needle 113 downward (i.e., in a valve closing direction) in FIG. 2. A spring 112*a* presses the needle 113 in the valve closing direction, independently of the command piston 112.

The injection control chamber 103 is formed in an upper portion of the command piston 112. In the control chamber 103, an injection control valve 109 including a solenoid actuator 109*a* is provided. By operating the solenoid actuator 109*a*, the hydraulic pressure in the control chamber 103 is discharged to a drain pipe (not shown) through an orifice 119. Also, the control chamber 103 is connected to a pressure boosting fuel passage 108 through an orifice 118, and is connected to the high pressure pipe 11-1 through a non-return valve 117.

In FIG. 2, a fuel injection passage 107 is provided. The fuel injection passage 107 is connected to the fuel pit 106 of the nozzle 105. When boosted pressure fuel injection is performed, the fuel whose pressure is boosted by the pressure boosting unit 110 is supplied to the fuel pit 106 through the fuel injection passage 107. When non-boosted pressure fuel injection is performed, the fuel is supplied to the fuel pit 106 from the common rail 3 through the fuel injection passage 107.

When the injection control valve 109 is in a closed state, the fuel pressure in the injection control chamber 103 is substantially equal to the pressure in the fuel injection passage 107 and the pressure in the fuel pit 106. In this state, the needle 113 is pressed by the spring 112*a* and the command piston 112, and the needle 113 is in close contact with a seat at a tip of the nozzle so as to close the nozzle hole 116.

Meanwhile, when electric current is supplied to the actuator 109*a*, and the injection control valve 109 is opened, the fuel in the control chamber 103 is discharged to the drain pipe through the orifice 119, and the pressure in the control chamber 103 is decreased.

As a result, the pressure in the control chamber 103 becomes lower than the pressure in the fuel injection passage 107 and the pressure in the fuel pit 106. Therefore, the needle 113 is pressed by the hydraulic pressure in the fuel pit 106, and is moved upward (i.e., in a valve opening direction) against the pressing force of the spring 112*a* and the command piston 112. Thus, the nozzle hole 116 is opened, and the fuel in the fuel pit 106 is injected from the nozzle hole 116.

Next, the pressure boosting unit 110 will be described.

The pressure boosting unit 110 includes a pressure boosting piston 104. The pressure boosting piston 104 includes a large-diameter piston portion 104*a* and a small-diameter piston portion 104*b*. A pressure boosting control chamber 114*b* is formed on the small-diameter piston portion 104*b* side of the large-diameter piston portion 104*a*. A hydraulic pressure chamber 114*a* is formed on a side of the large-diameter piston portion 104*b*, the side being opposite to the pressure boosting control chamber 114*b*. Communication is provided between the hydraulic pressure chamber 114*a* and the common rail 3 through the high pressure pipe 11-2. Further, a pressure boosting chamber 114*c* is formed so as to be adjacent to an end portion of the small-diameter piston portion 104*b* of the pressure boosting piston 104. Communication is provided between the pressure boosting chamber 114*c* and the pressure boosting fuel passage 108.

A spring 115 provided in the pressure boosting control chamber 114*b* constantly applies force to the pressure boosting piston 104 in an upward direction in FIG. 2.

In FIG. 2, a pressure boosting control valve 111 is provided. The pressure boosting control valve 111 is a solenoid-driven selector valve. The pressure boosting control valve 111 selectively connects the pressure boosting control chamber 114*b* to the common rail 3 or the drain pipe 111*a* through the high pressure pipe 11-3.

When the pressure boosting unit 110 is in a non-operated state, supply of electric current to a solenoid actuator for the pressure boosting control valve 111 is stopped, and the pressure boosting control chamber 114*b* is connected to the high pressure pipe 11-3 through the pressure boosting control valve 111. Therefore, the fuel pressure in the common rail 3 is applied to the pressure boosting control chamber 114*b*. Also, the pressure in the common rail 3 is applied to the hydraulic pressure chamber 114*a* of the pressure boosting unit 110 through the high pressure pipe 11-2. Therefore, the pressures on the both sides of the large-diameter piston portion 104*a* of the pressure boosting piston 104 become the same.

In this state, the pressure boosting piston 104 is pushed and moved upward by the spring 115 which urges the large-diameter piston portion 104*a* toward the hydraulic pressure chamber 114*a* side. The fuel flows into the pressure boosting chamber 114*c* from the common rail 3 through the pipe 11-1 and the non-return valve 117. Therefore, the fuel pressure in the pressure boosting fuel passage 108 and the fuel injection passage 107 becomes equal to the pressure in the common rail 3.

That is, when the pressure boosting unit 110 is in the non-operated state, the injection pressure of the fuel injection valve 10 becomes equal to the fuel pressure in the common rail 3.

Meanwhile, when electric current is supplied to the solenoid actuator for the pressure boosting control valve 111, the pressure boosting control chamber 114*b* is connected to the drain pipe 111*a* through the pressure boosting control valve 111. Thus, the fuel in the pressure boosting control chamber 114*b* is discharged to the drain pipe 111*a* through the pressure boosting control valve 111. As a result, the pressure in the pressure boosting control chamber 114*b* is sharply decreased.

Accordingly, the pressure boosting piston 104 is pressed by the hydraulic pressure in the hydraulic pressure chamber 114*a* which is applied to the large-diameter piston portion 104*a*, and the fuel in the pressure boosting chamber 114*c* is pressurized by the small-diameter piston portion 104*b*. Thus, the fuel pressure in the pressure boosting chamber 114*c* becomes substantially equal to a value obtained by multiplying the common rail fuel pressure in the hydraulic pressure chamber 114*a* by a cross-sectional area ratio between the large-diameter piston portion 104*a* and the small-diameter piston portion 104*b*.

That is, when the pressure boosting unit 110 is in the operated state, the pressure in the pressure boosting fuel passage 108 and the fuel injection passage 107, and the pressure in the injection control chamber 103 are increased to the boosted pressure obtained by multiplying the fuel pressure in the common rail 3 by the cross-sectional area ratio between the large-diameter piston portion 104*a* and the small-diameter piston portion 104*b*.

The ECU 20 controls opening/closing operation of the injection control valve 109, thereby controlling fuel injection starting timing and a fuel injection period (an injection amount) of the fuel injection valve 10. Also, the ECU 20 controls opening/closing operation of the pressure boosting control valve 111 so that the fuel pressure is boosted, or is not boosted. Also, the ECU 20 controls a difference between the operation starting timing of the pressure boosting control valve 111 and the operation starting timing of the injection control valve 109, thereby changing a time interval (i.e., a pressure boosting period) from when operation of the pressure boosting piston 104 is started (the fuel pressure actually starts to be increased) until when the fuel injection is started, as described later. Thus, the ECU 20 controls a fuel injection characteristic when the boosted pressure fuel injection is performed.

Thus, in the fuel injection valve 10 with the pressure boosting unit according to this embodiment, the fuel injection pressure can be increased from the low pressure (fuel pressure in the common rail 3) to the high pressure (boosted pressure) by changing the state of the pressure boosting unit 110 from the non-operated state to the operated state. In this case, when the fuel pressure is boosted, the boosted pressure is applied only to the pressure boosting chamber 114*c* of the pressure boosting unit 110, the pressure boosting fuel passage 108, the fuel injection passage 107, the nozzle portion 105, the injection control chamber 103, and the like. Accordingly, since the pressure boosting unit 110 is used, the designed pressure of almost all of the elements of the fuel injection apparatus such as the common rail 3 and the fuel pump 5 can be set to a relatively low value that is substantially equal to the designed pressure in the conventional apparatus. Therefore, it is possible to increase the fuel injection pressure to a large extent while suppressing an increase in the cost of the entire fuel injection apparatus.

Next, description will be made of a characteristic of change in the fuel injection pressure (pressure boosting characteristic) when the pressure boosting unit 110 is operated.

Figure 3:
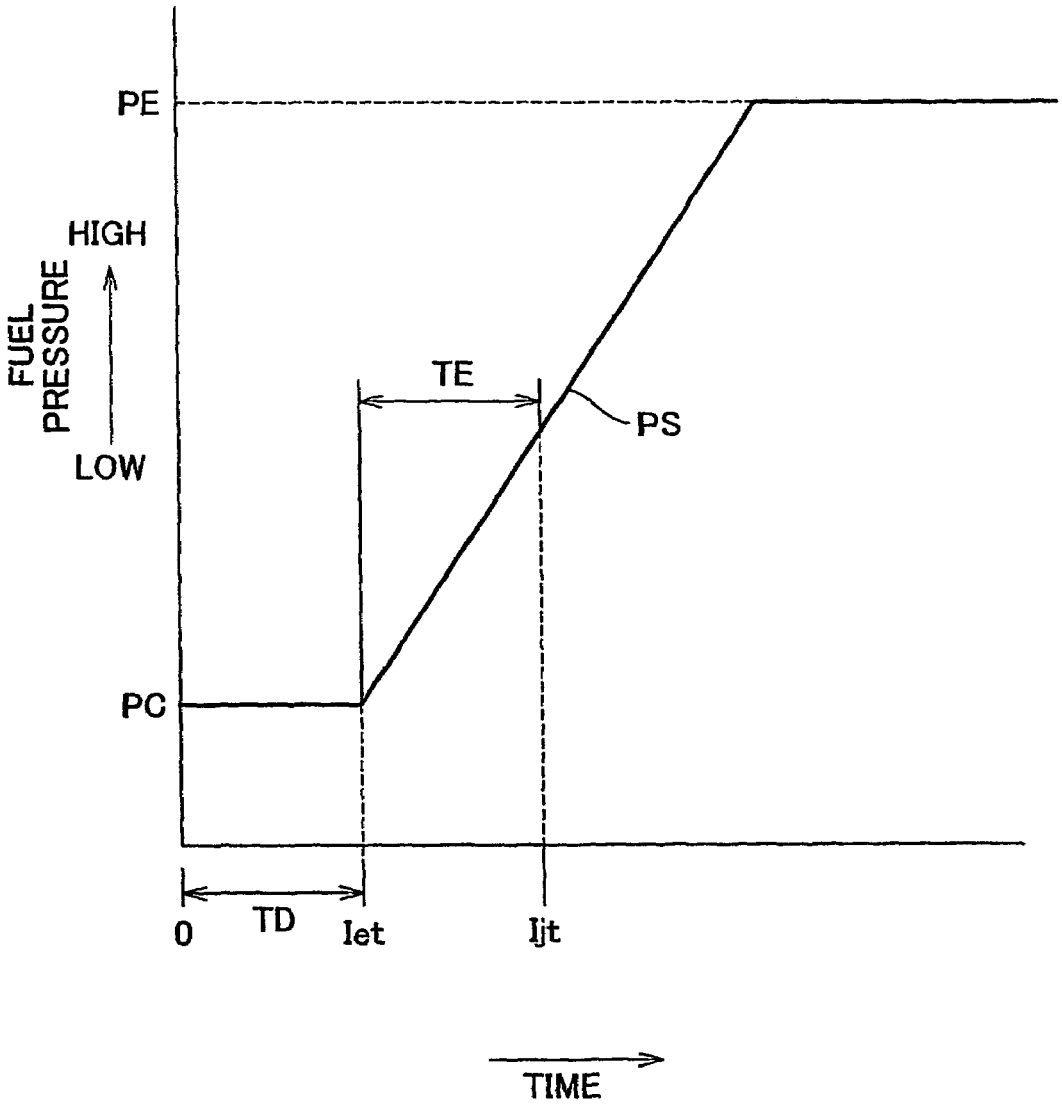
FIG. 3 is a diagram showing a pressure boosting characteristic of the pressure boosting unit.

FIG. 3 is a diagram explaining a change in the fuel pressure in the fuel injection passage 107 from a time point when a drive signal reaches the pressure boosting control valve 111 of the pressure boosting unit 110. In FIG. 3, a vertical axis indicates the fuel pressure, and a horizontal axis indicates elapsed time since the drive signal reaches the pressure boosting control valve 111 (i.e., a pressure boosting command is issued).

As shown in FIG. 3, even if the drive signal is supplied to the pressure boosting control valve 111, there is a delay period TD until the pressure boosting piston 104 actually starts to be moved and the fuel pressure starts to be increased. Therefore, the fuel pressure remains at a common rail pressure PC and is not changed during this period.

Then, after the delay period TD elapses, the pressure boosting piston 104 starts to be moved, and the fuel pressure is increased substantially linearly (during a pressure increasing period PS in FIG. 3).

In this embodiment, a time point Iet after the delay period TD elapses, that is, a time point at which operation of the pressure boosting piston 104 is started and the fuel pressure actually starts to be increased is referred to as "operation starting timing of the pressure boosting unit 110", or "pressure boosting starting timing".

After the pressure increasing period PS elapses, and the fuel pressure reaches a boosted pressure PE that is decided by the common rail pressure PC and the area ratio between the piston having the large diameter and the piston having the small diameter in the pressure boosting piston 104 (or pressure increasing ratio), the fuel pressure becomes constant. However, in a case where the fuel injection is performed during the pressure increasing period PS, the fuel injection pressure is changed during the fuel injection.

Meanwhile, as described above, in the conventional common rail fuel injection apparatus, fuel infection control parameters such as the fuel injection amount, fuel injection timing, and the fuel injection period are decided according to a procedure described below.

(1) The fuel injection amount is calculated based on the present accelerator pedal operation amount (required load) and the engine rotational speed, so that values of the fuel injection amount are obtained in the form of a numerical table (map) in which the accelerator pedal operation amount and the engine rotational speed are used as parameters.

(2) The common rail pressure (fuel injection pressure) is calculated based on the calculated fuel injection amount and the engine rotational speed, so that values of the common rail pressure are obtained in the form of a map in which the fuel injection amount and the engine rotational speed are used as parameters.

(3) The fuel injection period (the valve opening period of the fuel injection valve) is calculated based on the fuel injection amount and the calculated common rail pressure (fuel injection pressure), so that values of the fuel injection period are obtained in the form of a map in which the fuel injection amount and the common rail pressure are used as parameters.

(4) The fuel injection timing is calculated based on the fuel injection amount and the engine rotational speed, so that values of the fuel injection timing are obtained in the form of a map in which the fuel injection amount and the engine rotational speed are used as parameters.

According to the aforementioned conventional procedure, the fuel injection pressure (common rail pressure) is decided as the fuel injection control parameter, and is used for calculating the fuel injection period. However, as described above, when the boosted pressure fuel injection is performed, the fuel injection pressure may be changed. Therefore, for example, even when the fuel injection pressure is calculated according to the aforementioned procedure, it is difficult to control the actual fuel injection pressure so that the actual fuel injection pressure becomes equal to the calculated fuel injection pressure.

Also, it is theoretically possible to use, as a representative fuel injection pressure, the fuel injection pressure at specific timing, such as fuel injection starting timing at which the fuel injection is started, or fuel injection end timing at which the fuel injection is ended, and to perform control so that the representative fuel injection pressure becomes equal to the calculated fuel injection pressure. However, in order to perform this control, it is necessary to perform an additional complicated calculation considering a relationship between the increase in the fuel pressure after the fuel pressure starts to be boosted, and the fuel injection starting timing.

Further, in the case where the fuel injection period is decided using the map in which the fuel injection amount and the common rail pressure are used as parameters according to the conventional method, when the fuel injection pressure is changed, it is necessary to provide maps in which multiple parameters are used, for example, according to the change pattern of the fuel injection pressure during boosting of the pressure, and the injection starting timing, since the fuel injection period varies depending on a time point at which the fuel pressure used for deciding the fuel injection period is obtained. As a result, the calculation of the fuel injection period becomes complicated.

In this embodiment, the aforementioned problem is solved by using a pressure boosting period TE in FIG. 3 as the fuel injection control parameter, instead of the common rail pressure when the boosted pressure fuel injection is performed. The pressure boosting period is defined as a time interval from when the operation of the pressure boosting unit (pressure boosting piston 104) is started (i.e., from the pressure boosting starting timing Iet in FIG. 3) until when the fuel injection is started (i.e., until fuel injection timing Ijt in FIG. 3).

When the pressure boosting unit 110 in FIG. 2 and the pressure boosting control valve 111 in FIG. 2 are decided, the pressure boosting characteristic shown in FIG. 3 (the delay period TD, a gradient of a pressure boosting slope PS, a pressure increasing ratio PE/PC, and the like) becomes constant.

Accordingly, by maintaining a numerical map showing the pressure boosting characteristic in FIG. 3 at each common rail pressure, it is possible to determine the change in the fuel injection pressure when the common rail pressure is decided.

Also, when the fuel injection characteristic shown in FIG. 3 is decided, it is possible to determine the change in the fuel injection pressure after the fuel injection is started by deciding a position of the fuel injection timing on a characteristic line showing the fuel injection characteristic in FIG. 3.

In this embodiment, the pressure boosting period TE from when the fuel pressure starts to be boosted until when the fuel injection is started is used as the parameter for determining the fuel injection timing on the characteristic line in FIG. 3. Also, in order to further simplify the control, the common rail pressure is controlled to be a constant value irrespective of the engine operating state when the boosted pressure fuel injection is performed, instead of changing the common rail pressure according to the engine operating state as in the conventional case.

Thus, in this embodiment, the characteristic of change in the fuel injection rate after the fuel injection is started can be represented using only the pressure boosting period TE.

Further, in this embodiment, an actual engine is operated while the engine rotational speed and the fuel injection amount are changed, and an adjustment operation is performed for obtaining the pressure boosting period TE which makes it possible to obtain the optimal fuel injection characteristic at each combination of the engine rotational speed and the fuel injection amount. The obtained results are stored in the ROM of the ECU 20 in the form of a two dimensional numerical table (pressure boosting period map) in which the fuel injection amount and the engine rotational speed are used as parameters.

In this embodiment, the fuel injection amount is calculated based on the accelerator pedal operation amount and the engine rotational speed while the engine is operated as in the conventional case, and then, the pressure boosting period TE is calculated based on the calculated fuel injection amount and the engine rotational speed, using the aforementioned pressure boosting map.

Thus, in this embodiment, the fuel injection control can be performed without increasing the parameters or making the control complicated when the boosted pressure fuel injection is performed.

Figure 4:
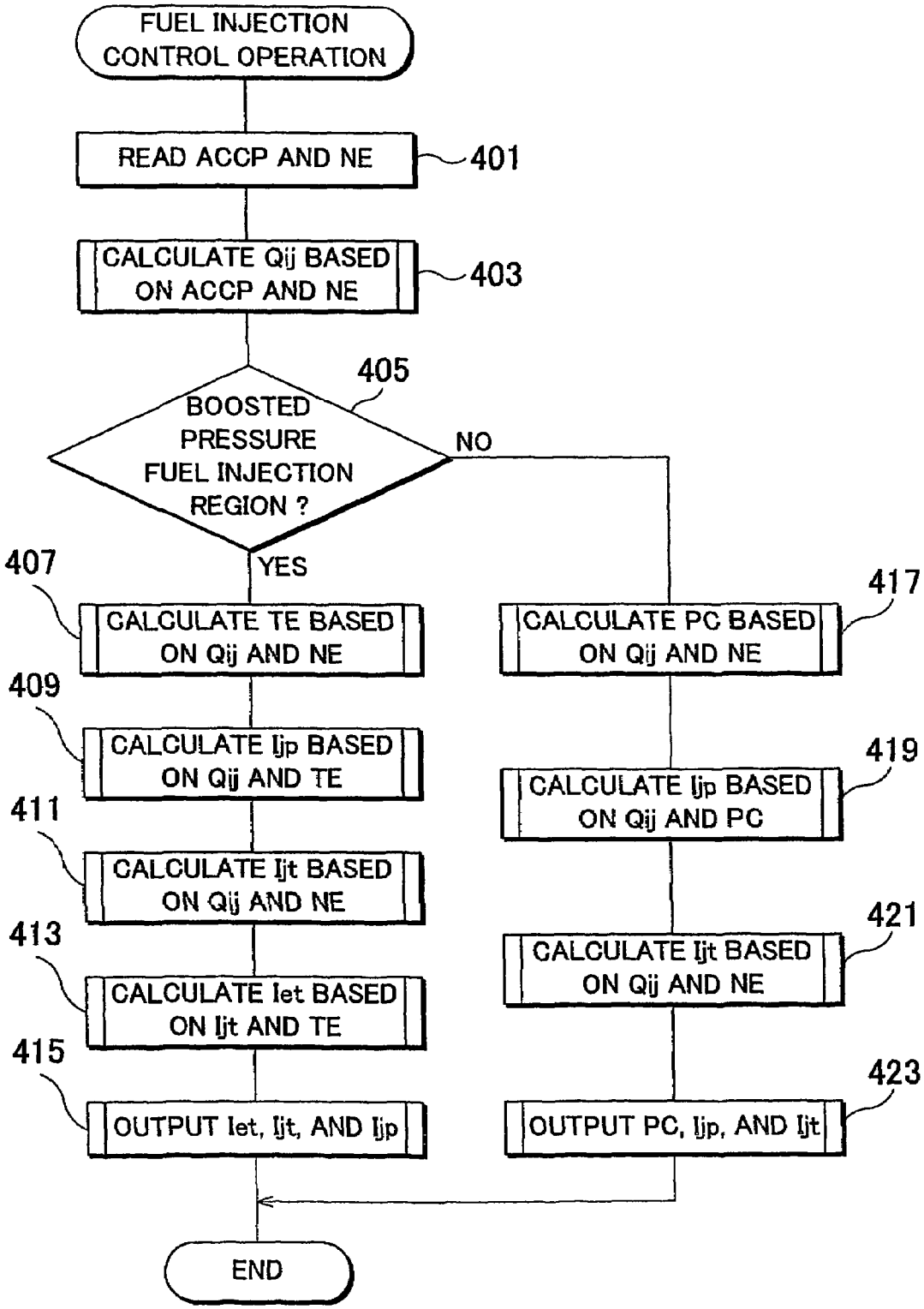
FIG. 4 is a flowchart explaining an example of fuel injection control operation according to the embodiment shown in FIG. 1.

FIG. 4 is a flowchart showing fuel injection control operation according to this embodiment. The control operation is performed by the ECU 20 at every constant crank angle (every time the fuel injection amount in each cylinder is calculated).

In the control operation shown in FIG. 4, first, in step 401, the present accelerator pedal operation amount (the depression amount of the accelerator pedal) ACCP and the engine rotational speed NE are read. In this embodiment, the accelerator pedal operation amount ACCP is calculated based on the output from the accelerator pedal operation amount sensor 21 (FIG. 1). The engine rotational speed NE is calculated based on the output from the crank angle sensor 25.

Then, in step 403, a fuel injection amount Qij is calculated based on the accelerator pedal operation amount ACCP and the engine rotational speed NE that are read.

In this embodiment as well, values of the fuel injection amount Qij are stored in advance in the ECU 20 in the form of a two dimensional numerical table (fuel injection amount map) in which the accelerator pedal operation amount ACCP and the engine rotational speed NE are used as parameters, as in the case of the conventional common rail fuel injection.

Also, in step 405, it is determined whether the engine is being operated in an engine operating region in which the boosted pressure fuel injection is performed, based on the fuel injection amount Qij thus calculated and the engine rotational speed NE.

In this embodiment, the engine operating region in which the boosted pressure fuel injection is performed using the pressure boosting unit is defined in advance using the fuel injection amount Qij and the engine rotational speed NE. The engine operating region is stored in the ROM of the ECU 20 in the form of a two dimensional numerical table (operating region map) in which the fuel injection amount Qij and the engine rotational speed NE are used as parameters. In step 405, it is determined whether the boosted fuel injection needs to be performed based on whether the present fuel injection amount Qij and the engine rotational speed NE are in this region.

When it is determined that the engine is being operated in the region in which the boosted pressure fuel injection is performed in step 405, step 407 is performed.

In step 407, the aforementioned pressure boosting period TE is calculated. As described above, the pressure boosting period TE is calculated based on the fuel injection amount Qij that is calculated in step 403, and the engine rotational speed NE, using the aforementioned pressure boosting period map stored in the ROM of the ECU 20.

Further, in step 409, the fuel injection period (the valve opening period of the fuel injection valve) Ijp is calculated. In this embodiment, the fuel injection period Ijp is obtained as a function of the fuel injection amount Qij and the pressure boosting period TE when the fuel injection valve is decided. That is, in this embodiment, when the pressure boosting period TE is decided, the change in the fuel injection pressure (fuel injection rate) after the fuel injection is started is decided. Thus, the fuel injection period Ijp required for injecting fuel of the required fuel injection amount Qij can be represented as a function of the fuel injection amount Qij and the pressure boosting period TE.

Figure 5:
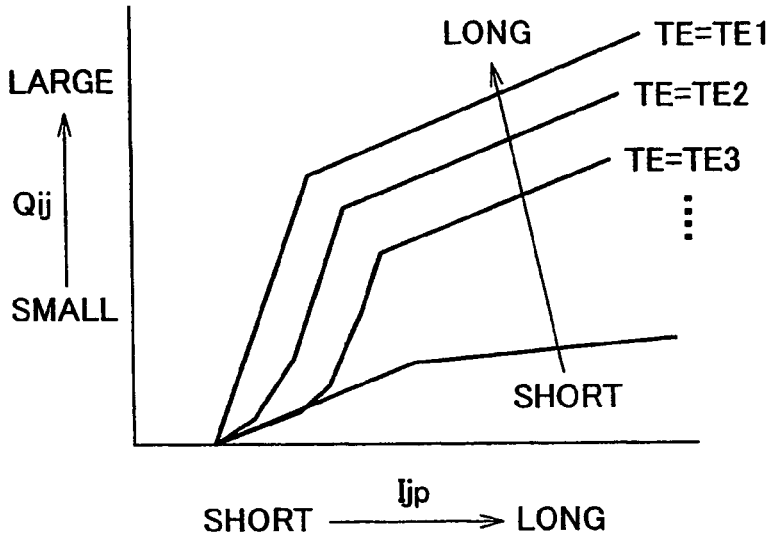
FIG. 5 is a diagram explaining a method of setting a fuel injection period when boosted pressure fuel injection is performed.

FIG. 5 shows an example of a relationship between the fuel injection period Ijp, and the fuel injection amount Qij and the pressure boosting period TE. In this embodiment, the relationship shown in FIG. 5 is stored in the ROM of the ECU 20 in the form of a mathematical expression. Alternatively, values of the fuel injection period Ijp are maintained in the ROM of the ECU 20 in the form of a two dimensional numerical table (fuel injection period map) in which the fuel injection amount Qij and the pressure boosting period TE are used as parameters. The fuel injection period Ijp is calculated based on the fuel injection amount Qij and the pressure boosting period TE that are calculated in step 405 and step 407, using the relationship or the fuel injection period map.

After the fuel injection period Ijp is calculated in the aforementioned manner, the fuel injection timing (fuel injection starting timing) Ijt is calculated based on the fuel injection amount Qij and the engine rotational speed NE according to the same procedure as the conventional procedure, in step 411. In this embodiment, the optimal fuel injection starting timing Ijt for injecting fuel of the fuel injection amount Qij is obtained in advance by operating the engine while changing the fuel injection amount Qij and the engine rotational speed NE, and performing actual measurement and the like. Values of the fuel injection timing Ijt are stored in the ROM of the ECU 20 in the form of a two dimensional numerical map (fuel injection timing map) in which the fuel injection amount Qij and the engine rotational speed NE are used as parameters, or in the form of a mathematical expression. In step 411, the fuel injection timing Ijt is calculated based on the fuel injection amount Qij and the engine rotational speed NE, using the fuel injection timing map (or the mathematical expression).

After the fuel injection timing Ijt is calculated in the aforementioned manner, in step 413, the pressure boosting starting timing Iet is calculated based on the pressure boosting period TE and the fuel injection timing Ijt calculated in step 411.

That is, the pressure boosting period TE is defined as the time interval between the pressure boosting starting timing Iet and the fuel injection timing Ijt. Therefore, when the fuel injection timing Ijt and the pressure boosting period TE are decided, the pressure boosting starting timing Iet can be calculated based on the fuel injection timing Ijt.

After the aforementioned operation is finished, in step 415, the pressure boosting starting timing Iet that is thus calculated is output to a drive circuit for the pressure boosting control valve 111, and the fuel injection timing Ijt and the fuel injection period Ijp are output to a drive circuit for the fuel injection valve in a corresponding cylinder. Then, the present control operation is finished.

The drive circuit for the pressure boosting control valve 111 outputs the drive signal to the pressure boosting control valve 111 at timing earlier than the calculated pressure boosting starting timing Iet by an operation delay period (for example, the delay period TD in FIG. 3) so that the actual pressure boosting starting timing matches the calculated pressure boosting starting timing Iet. Also, the drive circuit for the injection control valve 109 outputs the injection control valve 109 at timing earlier than the fuel injection timing Ijp by the operation delay period (for example, the delay period TD in FIG. 3) so that the actual fuel injection timing matches the calculated fuel injection timing Ijp.

Meanwhile, when it is determined that the engine is not being operated in the engine operating region in which the boosted pressure fuel injection is performed in step 405, the same common rail pressure fuel injection control as the conventional control (i.e., normal pressure fuel injection control) is performed in step 417 and subsequent steps.

That is, in step 417, the common rail pressure PC is calculated based on the fuel injection amount Qij calculated in step 403 and the engine rotational speed NE.

Figure 6:
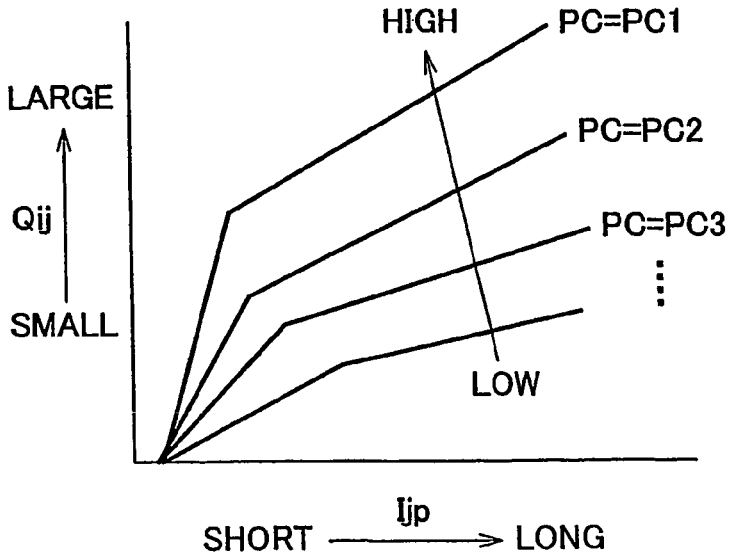
FIG. 6 is a diagram explaining a method of setting a fuel injection period when normal pressure fuel injection is performed.

Then, in step 419, the fuel injection period Ijp is calculated based on the common rail pressure PC and the fuel injection amount Qij. FIG. 6 is a diagram showing a relationship between the fuel injection period Ijp, and the common rail pressure PC and the fuel injection amount Qij in the same manner as in FIG. 5.

After the fuel injection period Ijp is calculated in the aforementioned manner, in step 421, the fuel injection timing Ijt is calculated based on the fuel injection amount Qij and the engine rotational speed NE.

Then, in step 423, the target common pressure PC that is calculated in the aforementioned manner is output to a common rail pressure control circuit (not shown). Also, the fuel injection period Ijp and the fuel injection timing Ijt are output to the drive circuit for the fuel injection valve. Then, the present control operation is finished.

That is, in this embodiment, the ECU 20 stores both of the fuel injection period Ijp for the boosted pressure fuel injection (FIG. 5) as the function of the pressure boosting period TE and the fuel injection amount Qij, and the fuel injection period Ijp for the normal pressure fuel injection (FIG. 6) as the function of the common rail pressure PC and the fuel injection amount Qij. When the boosted pressure fuel injection is performed, the fuel injection period Ijp is calculated using the relationship shown in FIG. 5 (or the numerical map) (step 409). Also, when the normal pressure fuel injection is performed, the fuel injection period Ijp is calculated using the relationship shown in FIG. 6 (or the numerical map) (step 419).

Thus, when the boosted pressure fuel injection is performed, the control suitable for the boosted pressure fuel injection mode is performed. Also, when the normal pressure fuel injection is performed, the control suitable for the normal pressure fuel injection mode is performed.

Next, description will be made of the pressure boosting period TE and the fuel injection pattern when the boosted pressure fuel injection is performed.

As described above, in this embodiment, the pressure boosting period TE is defined as the interval between the pressure boosting starting timing Iet and the fuel injection starting timing Ijt. When the pressure boosting period TE is changed, the fuel injection pressure (fuel injection rate) during the fuel injection period is changed. Thus, by using the pressure boosting period TE as the control parameter, it is possible to change the change pattern of the fuel injection rate when the fuel injection is performed.

Also, as described above, in this embodiment, when the boosted pressure fuel injection is performed, the common rail pressure PC is maintained at a constant value (base rail pressure) irrespective of the engine operating state, whereby the fuel injection control during the boosted pressure fuel injection is simplified. Further, in this embodiment, the common rail pressure PC is set to the lowest fuel injection pressure during the boosted pressure fuel injection.

Since the base rail pressure is set to the lowest fuel injection pressure during the boosted pressure fuel injection, the fuel injection may be performed at the base rail pressure during the fuel injection period even when the boosted pressure fuel injection is performed. That is, the fuel injection may be started before the fuel pressure starts to be boosted.

In this case, when the boosted pressure fuel injection is performed, it is complicated to perform the control in different manners according to whether the fuel injection starting timing is before or after the pressure boosting starting timing. Therefore, in this embodiment, the value of the fuel injection period TE can be both of a positive value and a negative value. In a case where the fuel injection is started after the fuel pressure starts to be boosted, the value of the fuel injection period TE is a positive value. In a case where the fuel injection is started before the fuel pressure starts to be boosted, the value of the fuel injection period TE is a negative value. Thus, the values of the fuel injection period TE can be indicated by one numerical table, irrespective of whether the fuel injection starting timing is before or after the pressure boosting starting timing. Thus, the fuel injection control is simplified.

FIG. 7A to FIG. 7E are diagrams each schematically showing a change pattern of the fuel injection rate when the pressure boosting period TE is changed.

Figure 7A:
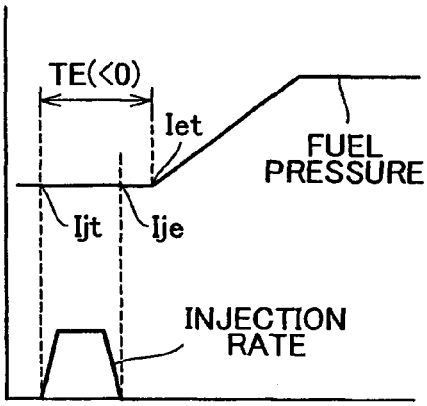
FIG. 7A to FIG. 7E are diagrams each schematically showing a change pattern of a fuel injection rate when a pressure boosting period TE is changed.
Figure 7D:
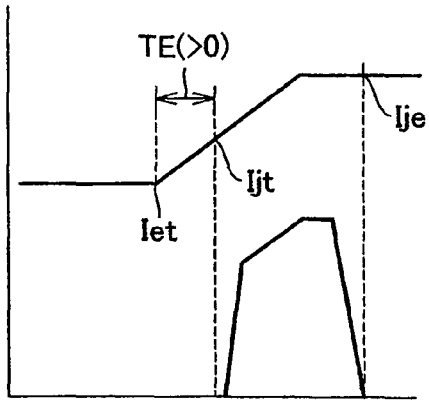
Figure 7B:
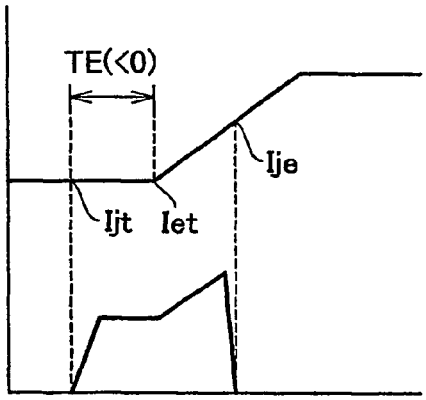
Figure 7E:
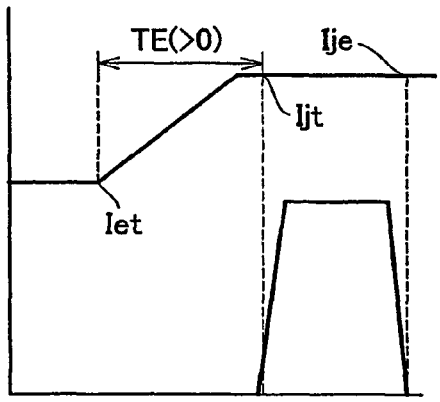
Figure 7C:
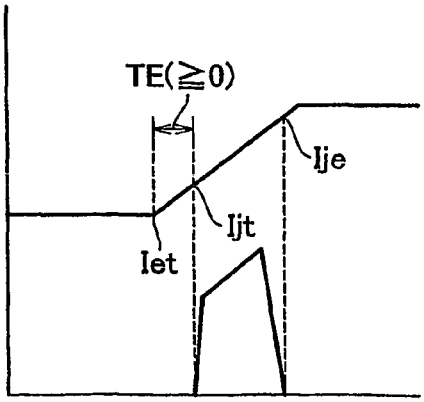

In each of FIG. 7A to FIG. 7E, an upper line indicates the pressure boosting characteristic of the pressure boosting unit as in FIG. 3, and a lower line indicates a change in the fuel injection rate when the fuel injection is performed. Also, the reference character Ijt indicates the fuel injection starting timing, the reference character Ije indicates the fuel injection end timing, and the reference character Iet indicates the pressure boosting starting timing. Also, each of FIG. 7A and FIG. 7B shows the case where the value of the pressure boosting period TE is a negative value, that is, the fuel injection starting timing Ijt is before the pressure boosting starting timing Iet. Each of FIG. 7C to FIG. 7E shows a case where the value of the pressure boosting period TE is a positive value, that is, the fuel injection starting timing Ijt is after the pressure boosting starting timing Iet.

Hereinafter, each of FIG. 7A to FIG. 7E will be described.

FIG. 7A shows the case where both of the fuel injection starting timing Ijt and the fuel injection end timing Ije are before the pressure boosting starting timing Iet. In this case, the fuel injection pressure is maintained at the base rail pressure during the fuel injection period. The fuel injection pattern shown in FIG. 7A is used when the engine is operated at a relatively low load.

FIG. 7B shows the case where the fuel injection starting timing Ijt is before the pressure boosting starting timing Iet (TE<0), and the fuel injection end timing Ije is after the pressure boosting starting timing Iet. In this case, as shown by the lower line indicating the fuel injection rate, the fuel injection rate is maintained at a relatively low constant value in an initial stage of the fuel injection. The fuel injection rate starts to be increased in the midst of the fuel injection.

In the fuel injection pattern shown in FIG. 7B, a relatively small amount of fuel is injected into the combustion chamber in the initial stage of the fuel injection. Then, after a temperature in the cylinder has been increased due to burning of the fuel, most part of the fuel is injected in a latter half of the fuel injection period. Therefore, the fuel is burned in a good state, and exhaust gas smoke and combustion noise are reduced. The fuel injection pattern shown in FIG. 7B is used mainly when the engine is operated at an intermediate load.

FIG. 7C shows a case where both of the fuel injection starting timing Ijt and the fuel injection end timing Ije are on the pressure boosting slope PS (refer to FIG. 3). In the case shown in FIG. 7C, the pressure boosting period TE is equal to or larger than 0.

In this case, the fuel injection rate is sharply increased when the fuel injection is started, and then is increased with an increase in fuel injection pressure (i.e., according to the gradient of the pressure boosting slope). In the fuel injection pattern in which the fuel injection rate is large in the initial stage of the fuel injection, and then the fuel injection is decreased, the amount of fuel supplied to the combustion chamber is relatively small in the end stage of the fuel injection when the combustion temperature is high. Therefore, an amount of generated NOx is reduced, and the combustion noised is reduced.

FIG. 7D shows a case where the fuel injection staring timing Ijt is on the pressure boosting slope PS, and the fuel injection end timing Ije is after the end of boosting of the fuel pressure. In this case, the fuel injection rate is changed in the initial stage of the fuel injection in the same manner as in FIG. 7C, and then the fuel injection at the boosted pressure (at the largest fuel injection rate) continues to be performed for a given period. Since the fuel injection rate is set to a relatively low value in a first half of the fuel injection period, and the fuel injection rate is set to a high value in the latter half of the fuel injection period in this manner, combustion noise and smoke can be reduced when a large amount of fuel is burned in the latter half of the fuel injection period. Accordingly, the fuel injection pattern shown in FIG. 7D is used when the engine is operated in the vicinity of a maximum torque point at which the maximum torque is generated, and a large amount of fuel needs to be injected.

FIG. 7E shows a case where the fuel injection is started after the fuel injection pressure reaches the boosted pressure PE. In this case, the fuel injection pressure (fuel injection rate) is fixed to the maximum value when the fuel injection is started, and therefore a large amount of fuel can be injected during the minimum fuel injection period.

Accordingly, the fuel injection pattern shown in FIG. 7E is used when the fuel injection period is set to be short, and the engine is operated in a high rotational speed high output torque region in the vicinity of a maximum output point at which the maximum output is generated, and a large amount of fuel needs to be injected.

Next, description will be made of operation of the pressure boosting unit in the case where the fuel injection is performed at the base rail pressure (shown in FIG. 7A).

As described above, in this embodiment, the base rail pressure is set to the lowest fuel injection pressure during the boosted pressure fuel injection. Therefore, when the boosted pressure fuel injection is performed, the fuel injection may be ended before the fuel pressure starts to be boosted. That is, in this case, the fuel injection pressure is maintained at the base rail pressure, and the fuel pressure does not need to be boosted. Therefore, the pressure boosting unit does not need to be operated.

Accordingly, in this embodiment, when the value of the pressure boosting period TE calculated in step 407 in FIG. 4 is a negative value, and an absolute value of the pressure boosting period TE is larger than a predetermined value $\alpha$ (i.e., $TE<-\alpha$), that is, when the fuel injection starting timing is sufficiently before the pressure boosting starting timing, it is determined that the fuel injection is ended before the fuel pressure starts to be boosted, and the pressure boosting unit 110 is not operated (that is, in this case, the ECU 20 does not output the drive signal to the pressure boosting control valve 111).

The predetermined value $\alpha$ is a value larger than the maximum value of the fuel injection period in the engine operating region in which the value of the pressure boosting period TE is a negative value. More particularly, the predetermined value $\alpha$ is decided, for example, through experiment performed using an actual engine. Generally, the predetermined value $\alpha$ is approximately several milliseconds.

Also, in this case, though the pressure boosting unit 110 is not operated, the fuel injection period Ijp is calculated in step 409 in FIG. 4, as in the case of the usual boosted pressure fuel injection.

Thus, since the pressure boosting unit 110 is prohibited from being operated when the pressure boosting unit 10 does not need to be operated during the boosted pressure fuel injection, the pressurized fuel does not need to be discharged to the drain pipe 111*a* as operating oil for the pressure boosting piston 104. Therefore, power consumption of the fuel injection pump 5 (FIG. 1) is reduced.

Next, description will be made of operation stop timing of the pressure boosting unit 110*a*, that is, timing at which operation of the pressure boosting unit 110 is stopped.

In the control operation shown in FIG. 4, the fuel injection starting timing Iet is decided based on the fuel injection starting timing Ijt and the pressure boosting period TE. Meanwhile, for example, the timing at which boosting of the fuel pressure is ended, that is, the operation stop timing of the pressure boosting unit 110 is set so that a pressure boosting continuing period during which the pressure boosting unit 110 continues to be operated becomes a constant period which is sufficiently longer than the fuel injection period.

However, a problem may occur if the pressure boosting unit 110 continues to be operated after the end of the fuel injection. For example, when the fuel injection is ended, the fuel injection valve is abruptly closed, and accordingly the fuel pressure in the fuel injection valve is sharply increased (i.e., pressure overshoot is caused). The increase in the pressure is transmitted in the fuel pipe leading to the fuel injection valve in the form of a pressure wave. Therefore, when the pressure wave is passing, the fuel pressure is increased at each portion through which the pressure wave passes. The pressure wave is reflected at both ends of the fuel passage (i.e., at the fuel injection valve and the common rail), and thus the pressure wave repeatedly goes and returns in the fuel passage. Therefore, pulsation of the fuel pressure repeatedly occurs in the fuel passage after the end of the fuel injection. A peak pressure when the pressure pulsation occurs is increased with an increase in the fuel pressure immediately before the pressure wave occurs, that is, when the fuel injection is ended.

Accordingly, for example, even when the boosted pressure is approximately 200 MPa, the peak pressure may be increased to approximately 300 MPa when the fuel injection valve is closed. Therefore, a problem occurs in which a design pressure at each portion needs to be equal to or higher than 300 MPa even when the maximum fuel injection pressure is 200 MPa.

In this embodiment, the problem is solved by stopping the operation of the pressure boosting unit 110 simultaneously with an end of the fuel injection.

As described above, in this embodiment, each of the fuel injection starting timing Ijt, the fuel injection period Ijp, and the pressure boosting starting timing Iet is decided by the control operation shown in FIG. 4.

Further, in this embodiment, a pressure boosting continuing period TEP is decided based on the fuel injection amount Qij and the engine rotational speed NE so that the operation of the pressure boosting unit 110 is stopped simultaneously with the end of the fuel injection.

As described with reference to FIG. 4, in this embodiment, the pressure boosting period TE is decided based on the fuel injection amount Qij and the engine rotational speed NE (step 407 in FIG. 4), and the fuel injection period Ijp is decided based on the pressure boosting period TE and the fuel injection amount Qij (step 409 in FIG. 4). Since the pressure boosting continuing period TEP is a sum of the pressure boosting period TE and the fuel injection period Ijp, the pressure boosting continuing period TEP can be decided based on the fuel injection amount Qij and the engine rotational speed NE.

In this embodiment, values of the pressure boosting continuing period TEP are calculated in advance based on combinations of the fuel injection amount Qij and the engine rotational speed NE, and are stored in the ROM of the ECU 20, for example, in the form of a two dimensional numerical table (pressure boosting continuing period map) in which the fuel injection amount Qij and the engine rotational speed NE are used as parameters. The pressure boosting continuing period TEP is calculated based on the fuel injection amount Qij and the engine rotational speed NE using the aforementioned pressure boosting continuing period map, together with the control operation in step 407 to step 413.

Also, in step 415, the pressure boosting continuing period TEP is output to the drive circuit (not shown) for the pressure boosting control valve 111, together with the pressure boosting starting timing Iet. The drive circuit for the pressure boosting control valve 111 adjusts on/off timing of the drive signal output to the pressure boosting control valve 111 so that the fuel pressure starts to be boosted at the pressure boosting starting timing Iet, and the actual operation of the pressure boosting unit 110 continues for the pressure boosting continuing period TEP, and then is finished, considering the delay in the operation of the pressure boosting system such as the pressure boosting control valve 111 and the pressure boosting piston 104.

Thus, since the operation of the pressure boosting unit is finished simultaneously with the end of the fuel injection, the fuel injection pressure starts to decrease simultaneously with the end of the fuel injection. Therefore, the peak pressure when the pressure pulsation is caused by ending the fuel injection is low as compared to the case where the pressure boosting unit 110 continues to be operated after the end of the fuel injection. As a result, the design pressure of the fuel system can be set to a low value.

Figure 8:
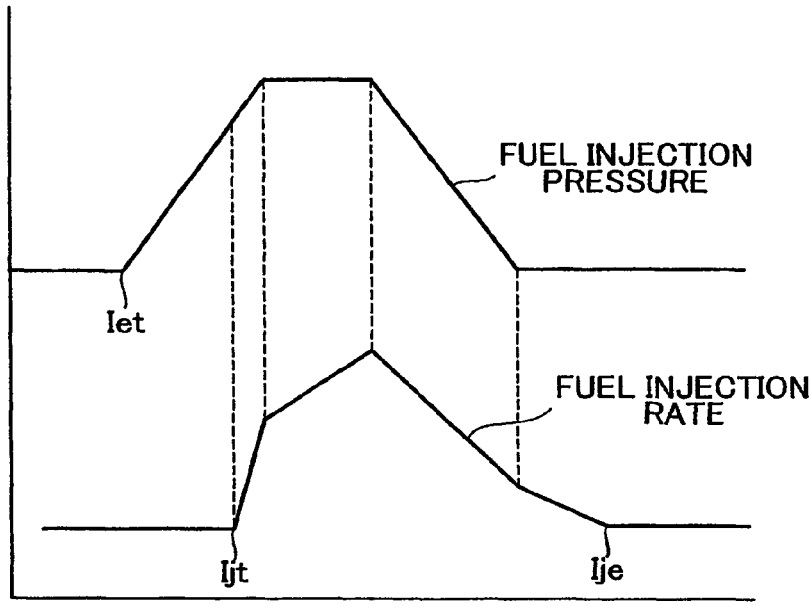
FIG. 8 is a diagram explaining a change in the fuel injection rate when operation of the pressure boosting unit is stopped before an end of fuel injection.

FIG. 8 shows a case where the operation stop timing of the pressure boosting unit 110 is controlled according to the fuel injection period in the same manner as described above, and the operation of the pressure boosting unit 110 is stopped before the end of the fuel injection. An upper line indicates a change in the fuel injection pressure, and a lower line indicates a change in the fuel injection rate.

In the case where the operation of the pressure boosting unit 110 is stopped before the end of the fuel injection as shown in FIG. 8, the fuel injection pressure is decreased during the fuel injection as shown by the upper line in FIG. 8. Therefore, the fuel injection rate is increased in the first half of the fuel injection period, and is sharply decreased in the latter half of the fuel injection period. Thus, it is possible to obtain the fuel injection rate characteristic shown by a characteristic line having a Δ shape.

Thus, since the operation of the pressure boosting unit 110 is stopped before the end of the fuel injection, it is possible to obtain the fuel injection rate characteristic that cannot be obtained in the conventional case. As a result, flexibility in setting the fuel injection rate characteristic is increased to a large extent. With respect to the fuel injection rate characteristic shown by the characteristic line having a Δ shape in FIG. 8, influence of this characteristic on the combustion state of the engine and the properties of exhaust gas has not been clarified, and will be studied in the future. However, it is expected that some kind of favorable effect can be obtained.

Since the operation of the pressure boosting unit 110 is stopped, and accordingly the fuel injection pressure is decreased before the end of the fuel injection as shown in FIG. 8, the peak pressure when the pressure pulsation is caused by ending the fuel injection is further decreased as compared to the aforementioned example. Therefore, the design pressure can be more effectively prevented from being unnecessarily increased.

Next, the base rail pressure will be described.

As described above, in this embodiment, the base rail pressure is set to the lowest fuel injection pressure during the boosted pressure fuel injection.

Thus, in this embodiment, the pressure increasing ratio of the pressure boosting unit 110 can be set to a low value as compared to a case where the base rail pressure is set to a value lower than the lowest fuel injection pressure during the boosted pressure fuel injection.

As the pressure increasing ratio of the pressure boosting unit 110 is decreased, the amount of oil (leak oil) discharged to the drain pipe 111*a* through the pressure boosting control valve 111 is reduced when the pressure boosting unit 110 is operated. Therefore, a load of the fuel injection pump 5 is reduced, and response of the pressure boosting unit 110 is improved.

Figure 9:
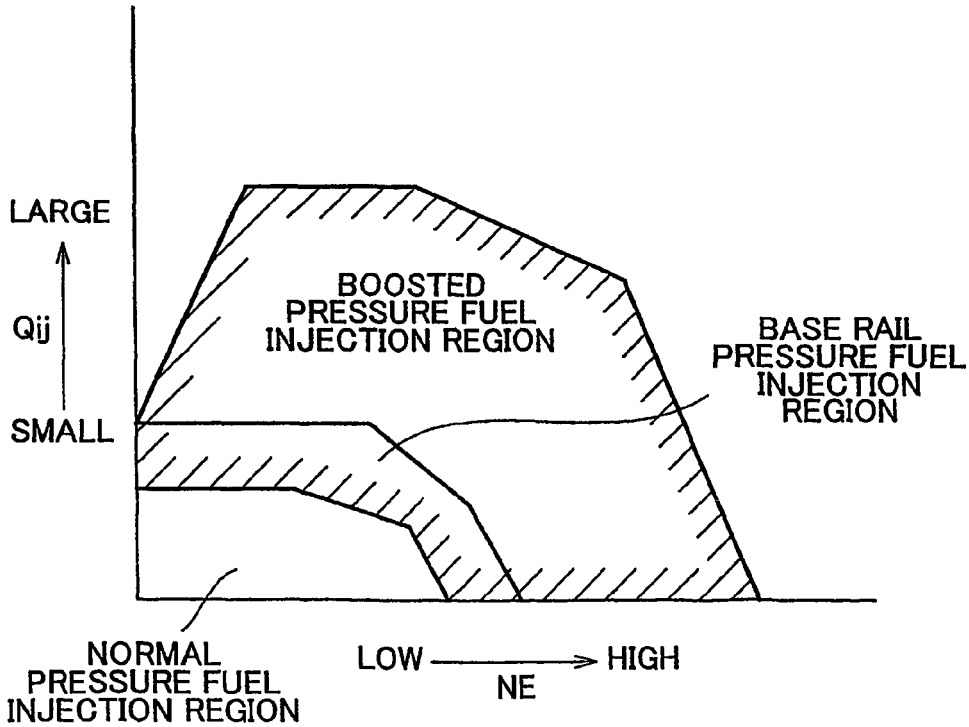
FIG. 9 is a diagram explaining an engine operating region in which the boosted pressure fuel injection is performed.

FIG. 9 is a diagram explaining an engine operating region in which the boosted pressure fuel injection is performed according to the embodiment.

In FIG. 9, a vertical axis indicates the fuel injection amount Qij, and a horizontal axis indicates the engine rotational speed NE. When the fuel injection amount Qij is not changed, the engine load is increased with an increase in the engine rotational speed NE. Also, when the engine rotational speed NE is not changed, the engine load is increased with an increase in the fuel injection amount Qij.

As shown in FIG. 9, in this embodiment, the boosted pressure fuel injection is performed in a relatively high load operating region in which the fuel injection amount is large and the engine rotational speed is high. The normal pressure fuel injection is performed (i.e., the fuel injection is performed while changing the common rail pressure according to the engine operating state) in a relatively low load operating region in which the fuel injection amount is small and the engine rotational speed is low. Also, in this embodiment, a base rail pressure fuel injection region in which the fuel injection is performed at the base rail pressure is provided in a boosted pressure fuel injection region in the vicinity of a boundary between the boosted pressure fuel injection region and a normal pressure fuel injection region. As described above, in the base rail pressure fuel injection region, since the boosted pressure fuel injection is performed without operating the pressure boosting unit 110, the fuel injection pressure is constant (base rail pressure).

Also, in the normal pressure fuel injection region, the common rail pressure is controlled according to the engine operating state. The base rail pressure is set to the maximum fuel injection pressure in the normal pressure fuel injection region.

Since the base rail pressure fuel injection region is provided between the boosted pressure fuel injection region on a high load side in which the pressure boosting unit 110 is operated, and the normal pressure fuel injection region on a low load side as shown in FIG. 9, it is possible to perform the fuel injection while continuously changing the fuel injection pressure from a pressure lower than the based rail pressure to the maximum fuel injection pressure (boosted pressure), according to the operating condition.

As described above, in this embodiment, the ECU 20 performs feedback control of a discharge volume of the fuel injection pump 5 based on the common rail pressure detected by the fuel pressure sensor 27, thereby controlling the common rail pressure to a target value. In the boosted pressure fuel injection region, the target value of the common rail pressure is the lowest fuel injection pressure (constant value) during the boosted pressure fuel injection. When the normal fuel injection is performed, the target value of the common rail pressure is decided based on the fuel injection amount Qij and the engine rotational speed NE.

Ordinarily, the common rail 3 is provided with a pressure adjusting valve (pressure reducing valve) for sharply reducing the common rail pressure, for example, when the fuel injection is performed after fuel cut at the time of deceleration. Therefore, in the normal pressure fuel injection region, feedback control of the pressure reducing valve may be performed based on the common rail pressure detected by the fuel pressure sensor 27 so that the common rail pressure becomes equal to a given value equal to or lower than the base rail pressure, instead of controlling the common rail pressure by changing the discharge volume of the fuel injection pump.

When the common rail pressure is controlled using the pressure reducing valve, there is a disadvantage that driving power for the fuel injection pump is increased due to discharge of pressurized fuel, as compared to when the common rail pressure is controlled by changing the discharge volume of the fuel injection pump. However, there is an advantage that the control of the pressure is simplified, as compared to when the common rail pressure is controlled by changing the discharge volume of the fuel injection pump.

Description has been made of the pressure boosting common rail fuel injection apparatus using the pressure boosting means including the pressure boosting piston. However, it is needless to say that the invention can be applied to a pressure boosting common rail fuel injection apparatus using other type of pressure boosting means.

The invention claimed is:

1. A fuel injection control method for controlling a fuel injection characteristic of a pressure boosting common rail fuel injection apparatus, the pressure boosting common rail fuel injection apparatus including a fuel injection valve which directly injects fuel into a combustion chamber of an internal combustion engine; a common rail which stores fuel having a predetermined pressure and supplies the fuel to the fuel injection valve; and a pressure boosting device that increases the pressure of the fuel supplied to the fuel injection valve from the common rail to a predetermined boosted pressure that is higher than the predetermined pressure of the fuel in the common rail, and the pressure boosting common rail fuel injection apparatus performing boosted pressure fuel injection by operating the pressure boosting device so as to increase a fuel injection pressure of the fuel injection valve when necessary, the fuel injection control method comprising the steps of:

deciding a fuel injection amount that is an amount of fuel to be injected from the fuel injection valve according to an engine operating state when the boosted pressure fuel injection is performed; and deciding a pressure boosting period that is defined as a time interval from when operation of the pressure boosting device is started until when the fuel injection is started, based on a relationship that is defined in advance using the decided fuel injection amount and an engine rotational speeds, wherein when the boosted pressure fuel injection is performed, the pressure of the fuel in the common rail is controlled to a constant base rail pressure irrespective of the engine operating state, fuel injection starting time is decided based on a relationship that is defined in advance using the fuel injection amount and the engine rotational speed, and operation starting time of the pressure boosting device at which operation of the pressure boosting device is started is decided based on the decided fuel injection starting time and the pressure boosting period.

2. The fuel injection control method according to claim 1, wherein the pressure boosting period is set to a negative value in a case where the fuel injection is started before the operation of the pressure boosting device is started, and the pressure boosting period is set to a positive value in a case where the fuel injection is started after the operation of the pressure boosting device is started.

3. The fuel injection control method according to claim 2, wherein a relationship between the operation starting time of the pressure boosting device and the fuel injection timing is set according to the engine operating state such that i) in a case where the engine is operated at an intermediate load, the fuel injection is started before the operation of the pressure boosting device is started, and the fuel injection is ended after the operation of the pressure boosting device is started, and before the pressure of the fuel supplied from the common rail to the fuel injection valve reaches the boosted pressure;

ii) in a case where the engine is operated at a load lower than the intermediate load, the fuel injection is ended before the operation of the pressure boosting device is started;

iii) in a case where the engine is operated in a vicinity of a maximum torque point, the fuel injection is started after the operation of the pressure boosting device is started, and before the pressure of the fuel supplied from the common rail to the fuel injection valve reaches the boosted pressure, and the fuel injection is ended after the pressure of the fuel reaches the boosted pressure; and iv) in a case where the engine is operated in a vicinity of a maximum output point, the fuel injection is started after the operation of the pressure boosting device is started, and after the pressure of the fuel supplied from the common rail to the fuel injection valve reaches the boosted pressure.

4. The fuel injection control method according to claim 1, wherein the pressure boosting device is prohibited from being operated in a case where the fuel injection is ended before the operation of the pressure boosting device is started.

5. The fuel injection control method according to claim 1, wherein switching is performed between the boosted fuel injection and normal pressure fuel injection that is performed with the pressure boosting device being in a non-operated state; the base rail pressure is set to a value equal to a lowest fuel injection pressure during the boosted pressure fuel injection; and in a case where the fuel injection pressure lower than the base rail pressure is required when the normal pressure fuel injection is performed, the pressure of the fuel in the common rail is set to a value lower than the base rail pressure by opening a pressure reducing valve provided in the common rail.

6. The fuel injection control method according to claim 5, wherein the boosted pressure fuel injection is performed in a first engine operating region in which the engine is operated at a high load; the normal pressure fuel injection is performed with the fuel injection pressure being set to the value lower than the base rail pressure in a second engine operating region in which the engine is operated at a load lower than the high load; and an engine operating region is provided in the first engine operating region in a vicinity of a boundary between the first engine operating region and the second engine operating region, and in the engine operating region, the fuel injection is performed with the pressure of the fuel in the common rail being set to a value equal to the base rail pressure, and with the pressure boosting device being in the non-operated state.

7. The fuel injection control method according to claim 5, wherein when the boosted pressure fuel injection is performed, a valve opening period of the fuel injection valve is decided based on a relationship that is predefined in advance using the pressure boosting period and the fuel injection amount; and when the normal pressure fuel injection is performed, the valve opening period of the fuel injection valve is decided based on the pressure of the fuel in the common rail and the fuel injection amount.

8. The fuel injection control method according to claim 1, wherein switching is performed between the boosted fuel injection and normal pressure fuel injection that is performed with the pressure boosting device is in a non-operated state; the base rail pressure is set to a value equal to a lowest fuel injection pressure during the boosted pressure fuel injection; and in a case where the fuel injection pressure lower than the base rail pressure is required when the normal pressure fuel injection is performed, the pressure of the fuel in the common rail is set to a value lower than the base rail pressure by controlling a discharge flow rate of a high pressure fuel injection pump which supplies the fuel to the common rail.

9. The fuel injection control method according to claim 8, wherein the boosted pressure fuel injection is performed in a first engine operating region in which the engine is operated at a high load; the normal pressure fuel injection is performed with the fuel injection pressure being set to the value lower than the base rail pressure in a second engine operating region in which the engine is operated at a load lower than the high load; and an engine operating region is provided in the first engine operating region in a vicinity of a boundary between the first engine operating region and the second engine operating region, and in the engine operating region, the fuel injection is performed with the pressure of the fuel in the common rail being set to a value equal to the base rail pressure, and with the pressure boosting device being in the non-operated state.

10. The fuel injection control method according to claim 8, wherein when the boosted pressure fuel injection is performed, a valve opening period of the fuel injection valve is decided based on a relationship that is predefined in advance using the pressure boosting period and the fuel injection amount; and when the normal pressure fuel injection is performed, the valve opening period of the fuel injection valve is decided based on the pressure of the fuel in the common rail and the fuel injection amount.

11. The fuel injection control method according to claim 1, wherein when the boosted pressure fuel injection is performed, a valve opening period of the fuel injection valve is decided based on a relationship that is defined in advance using the pressure boosting period and the fuel injection amount.

12. The fuel injection control method according to claim 1, wherein when the boosted pressure fuel injection is performed, the operation of the pressure boosting device is stopped simultaneously with an end of the fuel injection from the fuel injection valve.

13. The fuel injection control method according to claim 1, wherein when the boosted pressure fuel injection is performed, the operation of the pressure boosting device is stopped before an end of the fuel injection from the fuel injection valve.

14. A fuel injection apparatus comprising:

a fuel injection valve which directly injects fuel into a combustion chamber of an internal combustion engine;

a common rail which stores fuel having a predetermined pressure and supplies the fuel to the fuel injection valve;

a pressure boosting device which increases the pressure of the fuel supplied to the fuel injection valve from the common rail to a predetermined boosted pressure that is higher than the predetermined pressure of the fuel in the common rail; and a controller which decides a fuel injection amount that is an amount of fuel to be injected from the fuel injection valve according to an engine operating state when boosted pressure fuel injection is performed with the pressure boosting device being operated so as to increase a fuel injection pressure of the fuel injection valve, and which decides a pressure boosting period that is defined as a time interval from when operation of the pressure boosting device is started until when the fuel injection is started, based on the decided fuel injection amount and an engine rotational speeds wherein when the boosted pressure fuel injection is performed, the pressure of the fuel in the common rail is controlled to a constant base rail pressure irrespective of the engine operating state, fuel injection starting time is decided based on a relationship that is defined in advance using the fuel injection amount and the engine rotational speed, and operation starting time of the pressure boosting device at which operation of the pressure boosting device is started is decided based on the decided fuel injection starting time and the pressure boosting period.

* * * * *